US010787790B2

(12) United States Patent
Imura et al.

(10) Patent No.: US 10,787,790 B2
(45) Date of Patent: Sep. 29, 2020

(54) WORK MACHINE

(71) Applicant: Hitachi Construction Machinery Co., Ltd., Taito-ku, Tokyo (JP)

(72) Inventors: Shinya Imura, Toride (JP); Seiji Hijikata, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 311 days.

(21) Appl. No.: 15/754,693

(22) PCT Filed: Sep. 15, 2016

(86) PCT No.: PCT/JP2016/077244
§ 371 (c)(1),
(2) Date: Feb. 23, 2018

(87) PCT Pub. No.: WO2017/110167
PCT Pub. Date: Jun. 29, 2017

(65) Prior Publication Data

US 2018/0238025 A1 Aug. 23, 2018

(30) Foreign Application Priority Data

Dec. 22, 2015 (JP) ..... 2015-250590

(51) Int. Cl.
*E02F 9/22* (2006.01)
*F15B 21/08* (2006.01)
(Continued)

(52) U.S. Cl.
CPC ..... *E02F 9/22* (2013.01); *E02F 9/2025* (2013.01); *E02F 9/2217* (2013.01);
(Continued)

(58) Field of Classification Search
USPC ..... 701/50
See application file for complete search history.

(56) References Cited

U.S. PATENT DOCUMENTS 9,394,670 B2 * 7/2016 Hijikata ..... E02F 9/2095
9,394,922 B2 * 7/2016 Williamson ..... F15B 11/024
(Continued)

FOREIGN PATENT DOCUMENTS

JP 2003-227501 A 8/2003
JP 2008-89023 A 4/2008
(Continued)

OTHER PUBLICATIONS

Extended European Search Report issued in counterpart European Application No. 16878064.1 dated Aug. 9, 2019 (seven (7) pp.).
(Continued)

*Primary Examiner* — Tyler D Paige
(74) *Attorney, Agent, or Firm* — Crowell & Moring LLP

(57) ABSTRACT

Regeneration control is exercised and energy saving is realized even when an abnormality occurs to pressure sensors for hydraulic actuators. A work machine includes: a hydraulic pump (41*b*) that supplies a hydraulic fluid to a second hydraulic actuator (34); a regeneration circuit (47) that regenerates a return hydraulic fluid from a first hydraulic actuator (32) between the second hydraulic actuator (41*b*) and the hydraulic pump (41*b*); a discharge circuit (46) that discharges the return hydraulic fluid from the first hydraulic actuator (32) to a tank; a regeneration amount regulation device (45) that regulates a proportion of a flow rate of the return hydraulic fluid flowing to the regeneration circuit (47) and a flow rate of the return hydraulic fluid flowing to the discharge circuit (46); a controller (100) that controls the regeneration amount regulation device (45); a first operation amount sensor (53*a*) that detects an operation amount of the first operation device (51); and a first hydraulic actuator speed computing unit (111) that computes a speed of the first hydraulic actuator (32). The controller (111) controls the regeneration amount regulation device on the basis of the
(Continued)

operation amount detected by the first operation amount sensor (53*a*) and the speed computed by the first hydraulic actuator speed computing unit (111).

7 Claims, 6 Drawing Sheets

(51) Int. Cl.

| | |
|---|---|
| ***E02F 9/26*** | (2006.01) |
| ***F15B 11/024*** | (2006.01) |
| ***F15B 21/14*** | (2006.01) |
| ***E02F 9/20*** | (2006.01) |

(52) U.S. Cl.
CPC ..... *E02F 9/2228* (2013.01); *E02F 9/2292* (2013.01); *E02F 9/2296* (2013.01); *E02F 9/268* (2013.01); *F15B 11/024* (2013.01); *F15B 21/087* (2013.01); *F15B 21/14* (2013.01); *F15B 2211/20523* (2013.01); *F15B 2211/20546* (2013.01); *F15B 2211/20576* (2013.01); *F15B 2211/30595* (2013.01); *F15B 2211/633* (2013.01); *F15B 2211/6336* (2013.01); *F15B 2211/6346* (2013.01); *F15B 2211/665* (2013.01); *F15B 2211/6652* (2013.01); *F15B 2211/71* (2013.01); *F15B 2211/875* (2013.01); *F15B 2211/88* (2013.01)

(56) References Cited

U.S. PATENT DOCUMENTS

| | | | | |
|---|---|---|---|---|
| 10,344,458 | B2 * | 7/2019 | Hijikata | F15B 19/005 |
| 10,458,097 | B2 * | 10/2019 | Amano | B60W 10/26 |
| 2003/0145721 | A1 | 8/2003 | Oka et al. | |
| 2011/0082610 | A1 | 4/2011 | Kawasaki et al. | |
| 2012/0233995 | A1 * | 9/2012 | Kawasaki | E02F 9/2075 60/419 |
| 2014/0102289 | A1 | 4/2014 | Wu | |
| 2014/0283509 | A1 * | 9/2014 | Hijikata | F15B 11/044 60/414 |
| 2015/0059568 | A1 * | 3/2015 | Williamson | F15B 11/024 91/415 |
| 2017/0016208 | A1 * | 1/2017 | Saitoh | E02F 9/22 |
| 2018/0051720 | A1 * | 2/2018 | Hijikata | E02F 9/2217 |
| 2018/0066416 | A1 * | 3/2018 | Hijikata | E02F 9/2292 |
| 2018/0238025 | A1 * | 8/2018 | Imura | E02F 9/2228 |
| 2018/0258613 | A1 * | 9/2018 | Amano | B60K 6/48 |
| 2020/0056349 | A1 * | 2/2020 | Hijikata | F15B 21/14 |

FOREIGN PATENT DOCUMENTS

| | | | |
|---|---|---|---|
| JP | 5296570 | B2 | 9/2013 |
| JP | 2015-190518 | A | 11/2015 |
| JP | 2016-75302 | A | 5/2016 |
| KR | 10-2014-0021024 | A | 2/2014 |

OTHER PUBLICATIONS

International Search Report (PCT/ISA/210) issued in PCT Application No. PCT/JP2016/077244 dated Dec. 20, 2016 with English translation (four (4) pages).

Japanese-language Written Opinion (PCT/ISA/237) issued in PCT Application No. PCT/JP2016/077244 dated Dec. 20, 2016 (three (3) pages).

International Preliminary Report on Patentability (PCT/IB/338 & PCT/IB/373) issued in PCT Application No. PCT/JP2016/077244 dated Jul. 5, 2018, including English translation of document C2 (Japanese-language Written Opinion (PCT/ISA/237)) previously filed on Feb. 23, 2018 (six pages).

Korean-language Office Action issued in counterpart Korean Application No. 10-2018-7005393 dated Jul. 15, 2019 (five (5) pages).

* cited by examiner

WORK MACHINE

TECHNICAL FIELD

The present invention relates to a work machine and particularly relates to a work machine including hydraulic actuators that drive work members and regenerating energy from the hydraulic actuators.

BACKGROUND ART

There is disclosed a technique, for purposes of providing a hydraulic control system that can improve fuel economy by making effective use of potential energy stored by work members even in a work state in which acceleration is not necessary and a work machine including the hydraulic control system, for regenerating a hydraulic working fluid discharged from a bottom side of a boom cylinder on a rod side of an arm cylinder via a valve on a regeneration line and reducing a flow rate of a hydraulic pump for the arm cylinder in accordance with a flow rate of the regenerated hydraulic fluid on condition that a boom lowering operation and an arm pushing operation are performed simultaneously and a boom bottom pressure detected by one pressure sensor is higher than an arm rod pressure detected by another pressure sensor (refer to, for example, Patent Document 1).

PRIOR ART DOCUMENT

Patent Document

Patent Document 1: Japanese Patent No. 5296570

SUMMARY OF THE INVENTION

Problem to be Solved by the Invention

According to the technique of Patent Document 1 described above, it is possible to achieve improvement of fuel economy since the potential energy of the work members can be made effective use of. However, the technique has the following problem. Since a magnitude relationship between the boom bottom pressure and the arm rod pressure detected by the pressure sensors is the condition for opening a regeneration valve, occurrence of an abnormality (including, for example, breaking of a signal line) only to the pressure sensors makes it impossible to exercise regeneration control. Owing to this, it has been desired to provide a work machine capable of exercising regeneration control even when an abnormality occurs only to the pressure sensors.

The present invention has been achieved on the basis of these respects and an object of the present invention is to provide a work machine that can exercise regeneration control and realize energy saving even when an abnormality occurs to pressure sensors for hydraulic actuators.

Means for Solving the Problem

To solve the problem, the present invention adopts, for example, a configuration according to claims. The present application includes a plurality of means for solving the problem. As an example of the means, there is provided a work machine including: a first hydraulic actuator; a second hydraulic actuator; a first operation device that commands an operation of the first hydraulic actuator; a second operation device that commands an operation of the second hydraulic actuator; a hydraulic pump that supplies a hydraulic fluid to the second hydraulic actuator; a regeneration circuit that regenerates a return hydraulic fluid from the first hydraulic actuator between the second hydraulic actuator and the hydraulic pump; a discharge circuit that discharges the return hydraulic fluid from the first hydraulic actuator to a tank; a regeneration amount regulation device that regulates a proportion of a flow rate of the return hydraulic fluid flowing to the regeneration circuit and a flow rate of the return hydraulic fluid flowing to the discharge circuit; and a controller that controls the regeneration amount regulation device. The work machine includes: a first operation amount sensor that detects an operation amount of the first operation device; and a first hydraulic actuator speed computing unit that computes a speed of the first hydraulic actuator. The controller controls the regeneration amount regulation device on the basis of the operation amount of the first operation device detected by the first operation amount sensor and the speed of the first hydraulic actuator computed by the first hydraulic actuator speed computing unit.

Effect of the Invention

According to the present invention, it is possible to exercise regeneration control and realize energy saving even when an abnormality occurs to pressure sensors for hydraulic actuators.

MODES FOR CARRYING OUT THE INVENTION

Embodiments of the present invention will be described hereinafter with reference to the drawings while a hydraulic excavator as a work machine is taken by way of example. It is noted that the present invention is applicable to all types of hydraulic work machines including hybrid excavators and an applicable range of the present invention is not limited to hydraulic excavators.

First Embodiment

Figure 1:
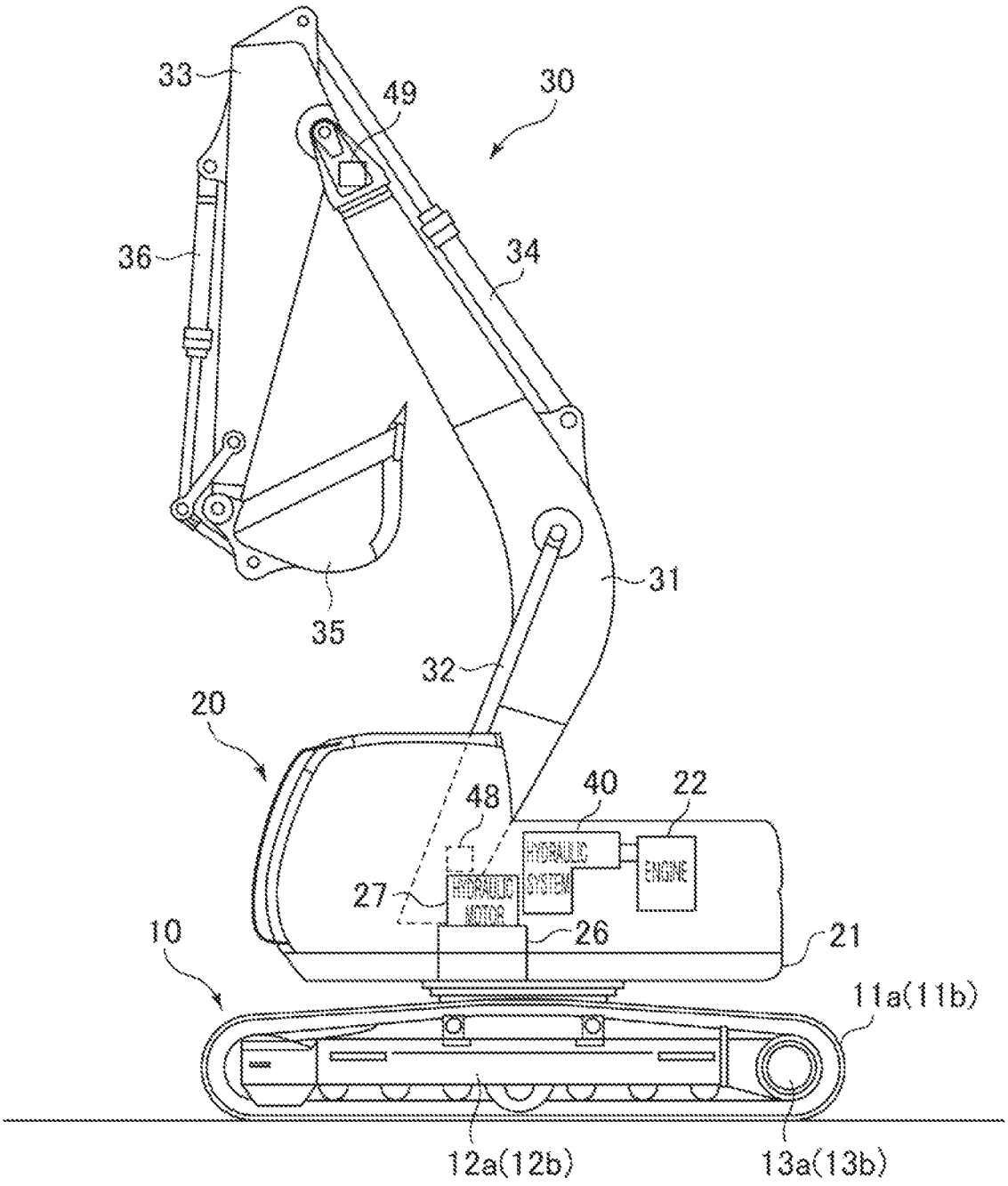
FIG. 1 is a side view showing a hydraulic excavator that is a first embodiment of a work machine according to the present invention.

FIG. 1 is a side view showing a hydraulic excavator that is a first embodiment of a work machine according to the present invention.

In FIG. 1, the hydraulic excavator includes a track structure 10, a swing structure 20 swingably provided on the track structure 10, and an excavator mechanism 30 attached to the swing structure 20.

The track structure 10 is configured with a pair of crawlers 11*a* and 11*b* and a pair of crawler frames 12*a* and 12*b* (only one side of each pair is shown in FIG. 1), a pair of track hydraulic motors 13*a* and 13*b* and speed reduction mechanisms of the track hydraulic motors 13*a* and 13*b* that control the crawlers 11*a* and 11*b* independently, and the like.

The swing structure 20 is configured with a swing frame 21, an engine 22 provided on the swing frame 21 and serving as a prime mover, a swing hydraulic motor 27, a speed reduction mechanism 26 reducing a speed of rotation of the swing hydraulic motor 27, and the like. A driving force of the swing hydraulic motor 27 is transmitted via the speed reduction mechanism 26, and the swing structure 20 (swing frame 21) is driven to swing with respect to the track structure 10 by the driving force.

Furthermore, the excavator mechanism (front implement) 30 is mounted in the swing structure 20. The excavator mechanism 30 is configured with a boom 31, a boom cylinder 32 for driving the boom 31, an arm 33 rotatably and pivotally supported by a neighborhood of a tip end portion of the boom 31, an arm cylinder 34 for driving the arm 33, a bucket 35 rotatably and pivotally supported by a tip end of the arm 33, a bucket cylinder 36 for driving the bucket 35, and the like.

Moreover, a hydraulic system 40 for driving hydraulic actuators such as the track hydraulic motors 13*a* and 13*b*, the boom cylinder 32, the arm cylinder 34, and the bucket cylinder 36 is mounted on the swing frame 21 of the swing structure 20.

Further, a boom angle sensor 48 that detects an angle of the boom 31 is provided in a base end portion of the boom 31 supported by the swing structure 20. An arm angle sensor 49 that detects an angle of the arm 33 with respect to the boom 31 is provided in the tip end portion of the boom 31 by which one end side of the arm 33 is rotatably supported. Angle signals detected by these angle sensors 48 and 49 are input to a controller 100 to be described later.

Figure 2:
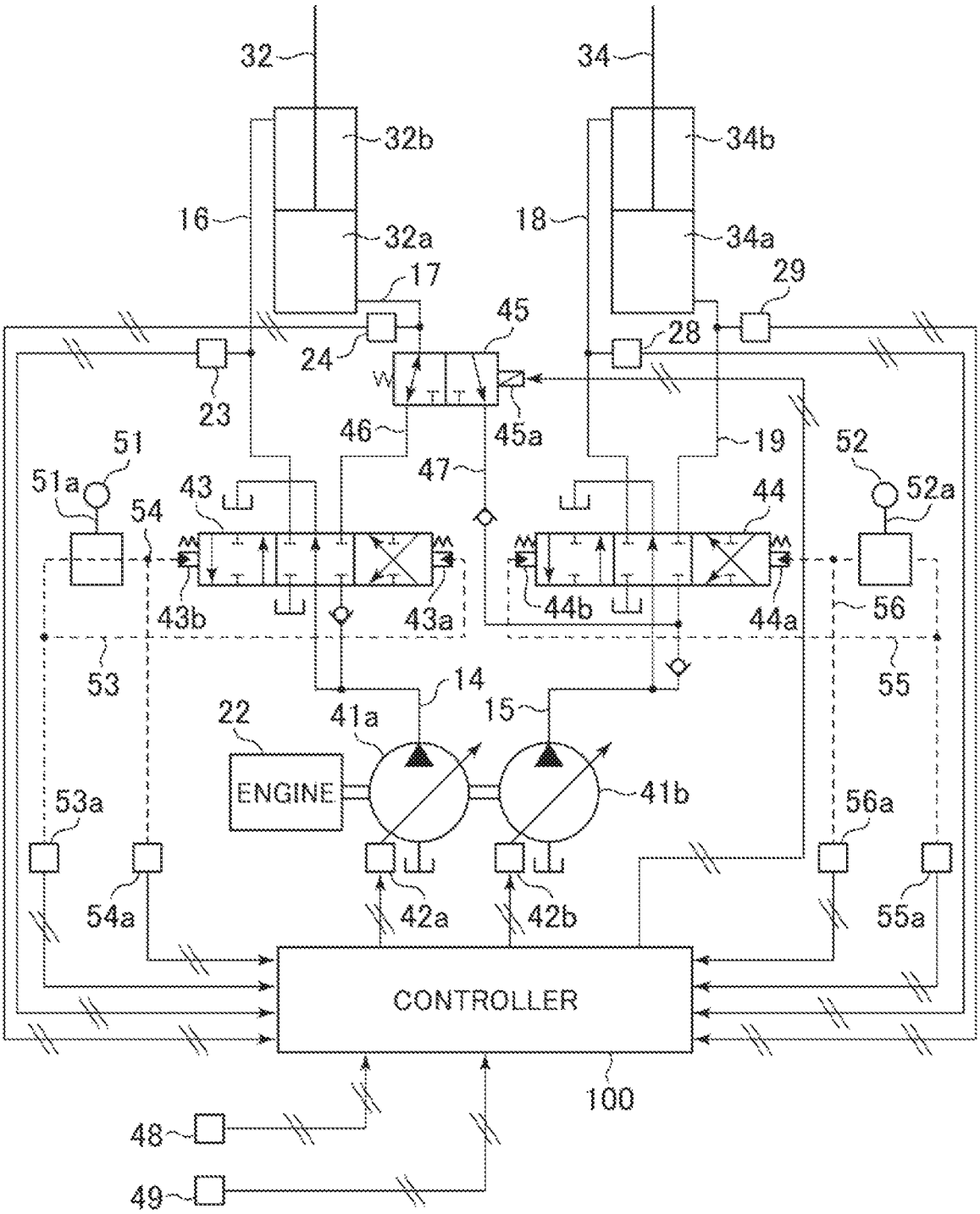
FIG. 2 is a schematic diagram showing an example of a hydraulic system that configures the first embodiment of the work machine according to the present invention.

FIG. 2 is a schematic diagram showing an example of a hydraulic system that configures the first embodiment of the work machine according to the present invention.

In FIG. 2, the hydraulic system 40 includes a first hydraulic pump 41*a* and a second hydraulic pump 41*b*, the boom cylinder 32 (first hydraulic actuator) to which a hydraulic fluid is supplied from the first hydraulic pump 41*a* and which drives the boom 31 (refer to FIG. 1) of the hydraulic excavator, the arm cylinder 34 (second hydraulic actuator) to which a hydraulic fluid is supplied from the second hydraulic pump 41*b* and which drives the arm 33 (refer to FIG. 1) of the hydraulic excavator, a boom spool 43 that controls a flow (a flow rate and a direction) of the hydraulic fluid supplied from the first hydraulic pump 41*a* to the boom cylinder 32, an arm spool 44 that controls a flow (a flow rate and a direction) of the hydraulic fluid supplied from the second hydraulic pump 41*b* to the arm cylinder 34, a boom operation device 51 (first operation device) that outputs an operation command for the boom 31 and changes over the boom spool 43, and an arm operation device 52 (second operation device) that outputs an operation command for the arm 33 and changes over the arm spool 44. While the first hydraulic pump 41*a* and the second hydraulic pump 41*b* are also connected to spools that are not shown so that the hydraulic fluids are supplied to other actuators that are not shown, circuit parts for these elements are omitted.

The first hydraulic pump 41*a* and the second hydraulic pump 41*b* are variable displacement hydraulic pumps that are driven to rotate by the engine 22 and deliver the hydraulic working fluids each proportional to a product between a revolution speed and a capacity and include regulators 42*a* and 42*b* serving as pump flow rate regulation devices, respectively. The regulators 42*a* and 42*b* are driven by control signals from the controller 100 (to be described later), thereby controlling tilting angles (capacities) of the hydraulic pumps 41*a* and 41*b* and controlling delivery flow rates thereof. The first hydraulic pump 41*a* and the second hydraulic pump 41*b* are connected to the boom spool 43 and the arm spool 44 via hydraulic fluid supply pipes 14 and 15, and the hydraulic fluids delivered by the hydraulic pumps 41*a* and 41*b* are supplied to the boom spool 43 and the arm spool 44.

The boom spool 43 and the arm spool 44 are connected to bottom-side hydraulic chambers 32*a* and 34*a* or rod-side hydraulic chambers 32*b* and 34*b* of the boom cylinder 32 and the arm cylinder 34 via bottom-side lines 17 and 19 or rod-side lines 16 and 18, respectively. The hydraulic fluids delivered by the hydraulic pumps 41*a* and 41*b* are supplied, in response to the switching positions of the respective spools 43 and 44, from the spools 43 and 44 to the bottom-side hydraulic chambers 32*a* and 34*a* or the rod-side hydraulic chambers 32*b* and 34*b* of the boom cylinder 32 and the arm cylinder 34 via the bottom-side lines 17 and 19 or the rod-side lines 16 and 18. At least part of the hydraulic fluid discharged from the boom cylinder 32 is recirculated from the boom spool 43 to a tank via a line. All of the hydraulic fluid discharged from the arm cylinder 34 is recirculated from the arm spool 44 to the tank via a line.

The boom operation device 51 and the arm operation device 52 have operation levers 51*a* and 52*a* and pilot valves that are not shown, respectively. The pilot valves are connected to operation sections 43*a* and 43*b* of the boom spool 43 and operation sections 44*a* and 44*b* of the arm spool 44 via pilot lines 53 and 54 and pilot lines 55 and 56.

When the boom operation lever 51*a* is operated in a boom raising direction (rightward in FIG. 2), the pilot valve generates an operation pilot pressure in response to an operation amount of the boom operation lever 51*a*. This operation pilot pressure is transmitted to the operation section 43*b* of the boom spool 43 via the pilot line 54, and a position of the boom spool 43 is changed over to a position in the boom raising direction (to a left-hand position in FIG. 2). When the boom operation lever 51*a* is operated in a boom lowering direction (leftward in FIG. 2), the pilot valve generates an operation pilot pressure in response to an operation amount of the boom operation lever 51*a*. This operation pilot pressure is transmitted to the operation section 43*a* of the boom spool 43 via the pilot line 53, and the position of the boom spool 43 is changed over to a position in the boom lowering direction (to a right-hand position in FIG. 2).

When the arm operation lever 52*a* is operated in an arm crowding direction (rightward in FIG. 2), the pilot valve generates an operation pilot pressure in response to an operation amount of the arm operation lever 52*a*. This operation pilot pressure is transmitted to the operation section 44*b* of the arm spool 44 via the pilot line 55, and a position of the arm spool 44 is changed over to a position in the arm crowding direction (to a left-hand position in FIG. 2). When the arm operation lever 52*a* is operated in an arm dumping direction (leftward in FIG. 2), the pilot valve generates an operation pilot pressure in response to an operation amount of the arm operation lever 52*a*. This operation pilot pressure is transmitted to the operation section 44*a* of the arm spool 44 via the pilot line 56, and the position of the arm spool 44 is changed over to a position in the arm dumping direction (to a right-hand position in FIG. 2).

The hydraulic system 40 according to the present embodiment includes, in addition to the constituent elements described above, a two-position, three-port regeneration control valve 45 that serves as a regeneration flow rate regulation device, that is disposed in the bottom-side line 17 of the boom cylinder 32, and that can distribute the flow rate of the hydraulic fluid discharged from the bottom-side hydraulic chamber 32*a* of the boom cylinder 32 to a boom spool 43-side (tank side) and a hydraulic fluid supply line 15-side of the arm cylinder 34 (regeneration line side); a regeneration line 47 that has one end connected to one outlet port of the regeneration control valve 45 and the other end connected to the hydraulic fluid supply line 15; a discharge line 46 that has one end connected to the other outlet port of the regeneration control valve 45 and the other end connected to a port of the boom spool 43; pressure sensors 23, 24, 28, and 29; and the controller 100.

The regeneration control valve 45 is a solenoid proportional valve including an electromagnetic solenoid section 45*a* that is directly controlled by electric power from the controller 100. The regeneration control valve 45 regulates a discharge flow rate of the hydraulic working fluid flowing from the bottom-side hydraulic chamber 32*a* of the boom cylinder 32 to the tank side (boom spool 43-side) and a regeneration flow rate of the hydraulic working fluid flowing from the bottom-side hydraulic chamber 32*a* of the boom cylinder 32 to an arm spool 44-side via the regeneration line 47 by controlling a stroke.

When the regeneration control valve 45 controls the hydraulic working fluid to flow from the boom cylinder bottom-side hydraulic chamber 32*a* to the arm spool 44 and the flow rate of the hydraulic working fluid delivered by the second hydraulic pump 41*b* is reduced in accordance with a flow rate of the hydraulic working fluid from the boom cylinder bottom-side hydraulic chamber 32*a*, it is possible to reduce power of the engine 22 that drives the hydraulic pumps 41*a* and 41*b* and, therefore, reduce fuel consumption without changing an operating speed of the arm 33. In addition, when the regeneration control valve 45 controls the hydraulic working fluid to flow from the boom cylinder bottom-side hydraulic chamber 32*a* to the arm spool 44 but the flow rate of the hydraulic working fluid delivered by the second hydraulic pump 41*b* is not reduced, it is possible to increase the operating speed of the arm 33.

The pressure sensor 23 is provided in the rod-side line 16 for the boom cylinder 32, and the pressure sensor 24 is provided in the bottom-side line 17 for the boom cylinder 32. The pressure sensor 28 is provided in the rod-side line 18 for the arm cylinder 34, and the pressure sensor 29 is provided in the bottom-side line 19 for the arm cylinder 34.

A pressure sensor 53*a* is provided in the pilot line 53 and detects the operation pilot pressure in the boom lowering direction generated by the boom operation device 51, and a pressure sensor 54*a* is provided in the pilot line 54 and detects the operation pilot pressure in the boom raising direction generated by the boom operation device 51. In addition, a pressure sensor 55*a* is provided in the pilot line 55 for the arm operation device 52 and detects the operation pilot pressure in the arm crowding direction generated by the arm operation device 52, and a pressure sensor 56*a* is provided in the pilot line 56 for the arm operation device 52 and detects the operation pilot pressure in the arm dumping direction generated by the arm operation device 52.

The controller 100 receives detection signals input from the pressure sensors 23, 24, 28, 29, 53*a*, 54*a*, 55*a*, and 56*a*, performs predetermined computation on the basis of those signals, and outputs control commands to the regeneration control valve 45 that is the solenoid proportional valve and the regulators 42*a* and 42*b*. In the present embodiment, a case in which the pressure sensors 23, 24, 28, and 29 for the hydraulic actuators fail is assumed and the controller that does not use input signals from these pressure sensors for the hydraulic actuators will be described. The boom angle signal detected by the boom angle sensor 48 and the arm angle signal detected by the arm angle sensor are input to the controller 100 in place of the signals from these pressure sensors.

Figure 3:
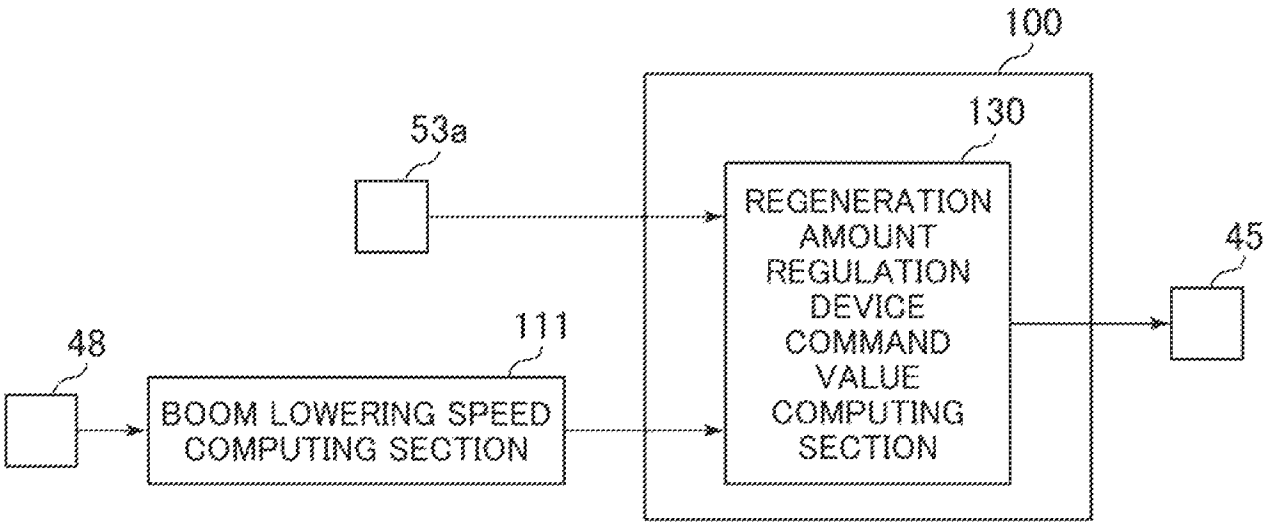
FIG. 3 is a control block diagram of a controller that configures the first embodiment of the work machine according to the present invention.

A control method according to the present embodiment will next be described with reference to FIG. 3. FIG. 3 is a control block diagram of the controller that configures the first embodiment of the work machine according to the present invention. In FIG. 3, constituent elements denoted by the same reference characters as those shown in FIGS. 1 and 2 are the same as those shown in FIGS. 1 and 2; detailed description thereof will be, therefore, omitted.

As shown in FIG. 3, control according to the present embodiment is configured with the controller 100, the pressure sensor 53*a* that serves as a boom lowering operation amount detection unit, a boom lowering speed computing unit 111, and the regeneration control valve 45 that serves as a regeneration amount regulation device, and internal computation of the controller 100 is configured with a regeneration amount regulation device command value computing section 130.

The boom lowering operation amount detection unit is configured with, for example, the pressure sensor 53*a* that detects the operation pilot pressure in the boom lowering direction generated by the boom operation device 51. A signal of a boom lowering amount detected by the pressure sensor 53*a* is output to the regeneration amount regulation device command value computing section 130 of the controller 100.

The boom lowering speed computing unit 111 is configured with, for example, the boom angle sensor 48 that detects the angle of the boom 31 with respect to the swing structure 20, and another controller that computes an angular speed by performing differential computation on the boom angle signal detected by the boom angle sensor 48 and that outputs a signal of the calculated angular speed to the regeneration amount regulation device command value computing section 130 of the controller 100 as a boom lowering speed signal. This controller referred to as another controller is provided separately from the controller 100.

It is noted that the controller 100 may execute computation of the angular speed; in that case, a value detected by the boom angle sensor 48 is directly input to the controller 100. Furthermore, a displacement sensor (boom stroke sensor) that detects a displacement of the boom cylinder 32 may be used in place of the boom angle sensor 48. In this case, the controller computes the boom lowering speed by differentiating the detected displacement signal similarly to the boom angle sensor 48. Moreover, if the angle sensor or the cylinder displacement sensor used in the boom lowering speed computing unit 111 is commonly used as that used in a stability calculation or a computer aided construction during crane work, it is possible to achieve cost saving.

The regeneration control valve 45 that serves as the regeneration amount regulation device is driven on the basis of a command value (electric power) received in the electromagnetic solenoid section 45*a* from the controller 100 to change over a valve position. When the command value is equal to or lower than a minimum value, the regeneration control valve 45 is driven to a position at which a return hydraulic fluid from the boom cylinder bottom-side hydraulic chamber 32*a* entirely flows to the boom spool 43. When the command value is a maximum value, the regeneration control valve 45 is driven to a position at which the return hydraulic fluid from the boom cylinder bottom-side hydraulic chamber 32*a* entirely flows to the arm spool 44. When the command value is between the minimum value and the maximum value, the regeneration control valve 45 is driven to a position at which the return hydraulic fluid from the boom cylinder bottom-side hydraulic chamber 32*a* is distributed to the boom spool 43 and the arm spool 44. It is noted that the regeneration control valve 45 that serves as the regeneration amount regulation device may be configured such that a hydraulic pressure is generated on the basis of the command value from the controller without using the electric power at a time of changing over the position of the regeneration control valve 45 and that the valve is changed over by the hydraulic pressure. In this case, the command value to the valve may be in a range, for example, from 0 MPa to 4 MPa.

First, the regeneration amount regulation device command value computing section 130 computes a boom lowering speed target value in such a manner that the boom lowering speed target value becomes higher as the input boom lowering operation amount is higher using a preset table. Next, the regeneration amount regulation device command value computing section 130 subtracts an actual boom lowering speed (a value computed by the boom lowering speed computing unit 111) from the computed boom lowering speed target value to calculate a deviation. Finally, the regeneration amount regulation device command value computing section 130 computes the regeneration amount regulation device command value in such a manner that the regeneration amount regulation device command value is closer to the minimum value as the deviation is larger in a positive direction, and that the regeneration amount regulation device command value is closer to the maximum value as the deviation is larger in a negative direction using a preset table, and outputs the regeneration amount regulation device command value.

Specifically, when the actual boom lowering speed is lower than the boom lowering speed target value, the deviation becomes large in the positive direction. In this case, the regeneration amount regulation device command value computing section 130 makes the command value closer to the minimum value. Through this computation, the regeneration control valve 45 is driven to the position at which the return hydraulic fluid from the boom cylinder bottom-side hydraulic chamber 32*a* entirely flows to the boom spool 43. The boom lowering speed, therefore, increases to be closer to the boom lowering speed target value. Conversely, when the actual boom lowering speed is higher than the boom lowering speed target value, the deviation becomes large in the negative direction. In this case, the regeneration amount regulation device command value computing section 130 makes the command value closer to the maximum value. Through this computation, the regeneration control valve 45 is driven to the position at which the return hydraulic fluid from the boom cylinder bottom-side hydraulic chamber 32*a* entirely flows to the arm spool 44. The boom lowering speed, therefore, decreases to be closer to the boom lowering speed target value.

Exercising control as described above enables a regeneration amount to be regulated in such a manner that the boom lowering speed conforms with the target speed. It is noted that control may be exercised on the basis of not the deviation but an integral value of the deviation, whereby it is possible to eliminate a stationary deviation.

According to the first embodiment of the work machine of the present invention described above, it is possible to exercise regeneration control and realize energy saving even when an abnormality occurs to the pressure sensors for the hydraulic actuators.

While the control exercised when the pressure sensors for the hydraulic actuators fail has been described in the present embodiment, the present invention is also applicable to a work machine that does not originally include these pressure sensors.

Second Embodiment

Figure 4:
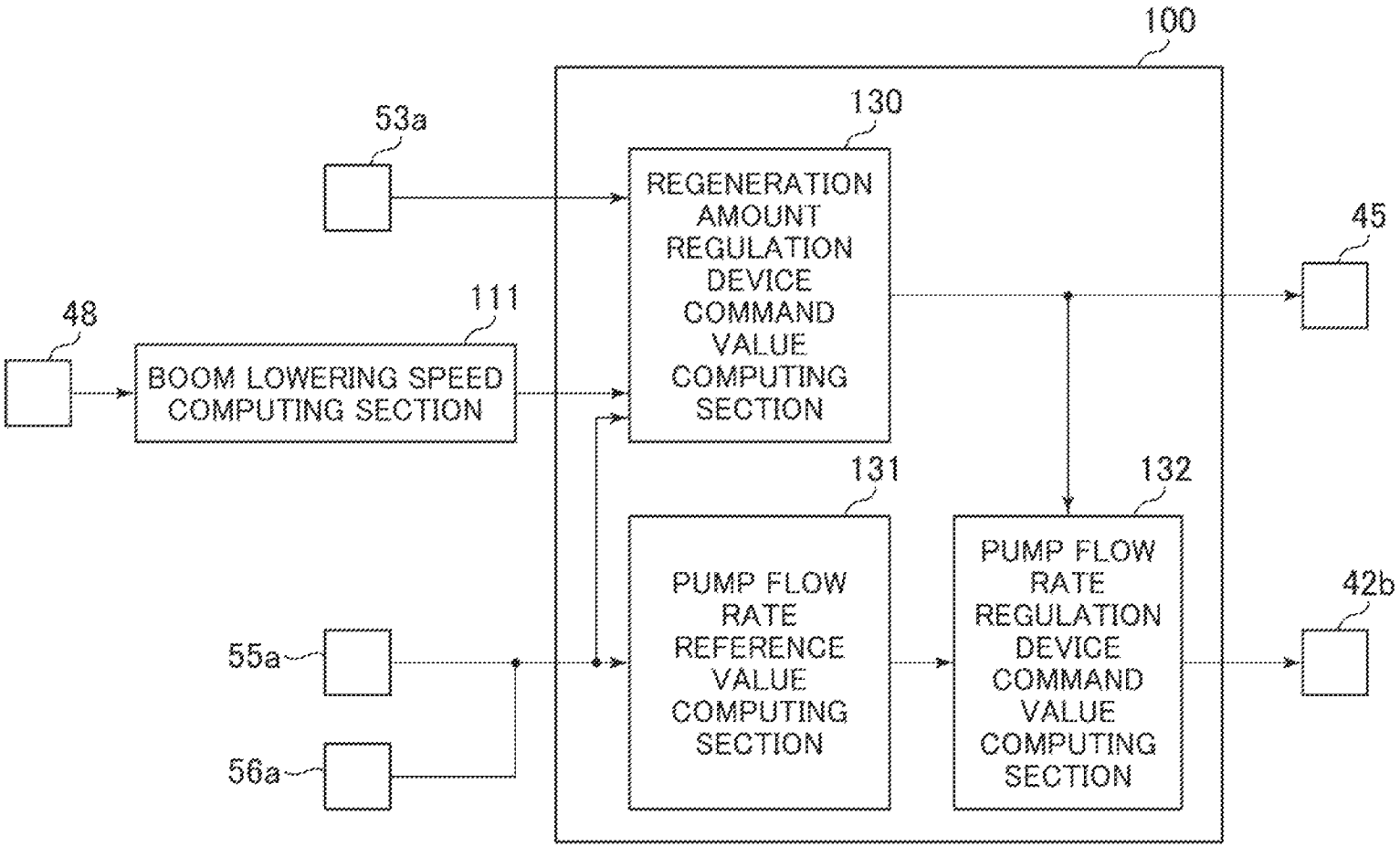
FIG. 4 is a control block diagram of a controller that configures a second embodiment of the work machine according to the present invention.

A second embodiment of the work machine according to the present invention will be described hereinafter with reference to the drawings. FIG. 4 is a control block diagram of a controller that configures the second embodiment of the work machine according to the present invention. In FIG. 4, constituent elements denoted by the same reference characters as those shown in FIGS. 1 to 3 are the same as those shown in FIGS. 1 to 3; detailed description thereof will be, therefore, omitted.

In the second embodiment of the work machine according to the present invention, the control block diagram is additionally configured with the pressure sensors 55*a* and 56*a* that serve as an arm operation amount detection unit and the regulator 42*b* that serves as the pump flow rate regulation device, compared with the control block diagram of the first embodiment shown in FIG. 3. In addition, the internal computation of the controller is additionally configured with a pump flow rate reference value computing section 131 and a pump flow rate regulation device command value computing section 132.

The arm operation amount detection unit is configured with, for example, the pressure sensor 55*a* that detects the operation pilot pressure in the arm crowding direction generated by the arm operation device 52, and the pressure sensor 56*a* that detects the operation pilot pressure in the arm dumping direction. Signals of arm operation amounts detected by the pressure sensors 55*a* and 56*a* are output to the regeneration amount regulation device command value computing section 130 and the pump flow rate reference value computing section 131 of the controller 100.

The regulator 42*b* that serves as the pump flow rate regulation device is driven on the basis of a command value (electric power) from the controller 100, and controls a pump delivery flow rate by regulating the tilting angle (capacity) of the second hydraulic pump 41*b*. When the command value is a minimum value, the regulator 42*b* regulates the tilting angle of the second hydraulic pump 41*b* in such a manner that the capacity thereof becomes a minimum. When the command value is a maximum value, the regulator 42*b* regulates the tilting angle of the second hydraulic pump 41*b* in such a manner that the capacity thereof becomes a maximum. When the command value is between the minimum value and the maximum value, the regulator 42*b* regulates the tilting angle of the second hydraulic pump 41*b* in such a manner that the capacity thereof becomes a value between the minimum value and the maximum value. It is noted that the regulator 42*b* that serves as the pump flow rate regulation device may be configured such that a hydraulic pressure is generated on the basis of the command value from the controller without using the electric power at a time of regulating the tilting angle of the second hydraulic pump 41*b* and that the tilting angle is changed over by the hydraulic pressure. In this case, the command value for the hydraulic pressure may be in a range, for example, from 0 MPa to 4 MPa.

The regeneration amount regulation device command value computing section 130 computes the regeneration amount regulation device command value from the boom lowering operation amount from the boom lowering operation amount detection unit and the boom lowering speed from the boom lowering speed computing unit 111, and outputs the regeneration amount regulation device command value, similarly to the first embodiment. This enables the regeneration amount to be regulated in such a manner that the boom lowering speed conforms with the target speed. In the present embodiment, an arm crowding operation amount and an arm dumping operation amount are input from the arm operation amount detection unit. This is intended to make it possible to add a function of setting a command value to be output to 0 since regeneration is unnecessary when the arm crowding operation amount and the arm dumping operation amount are both 0.

First, the pump flow rate reference value computing section 131 computes pump flow rate reference value 1 in such a manner that the pump flow rate reference value 1 becomes higher as the input arm crowding operation amount is higher using a preset table. Likewise, the pump flow rate reference value computing section 131 computes pump flow rate reference value 2 in such a manner that the pump flow rate reference value 2 becomes higher as the input arm dumping operation amount is higher using a preset table. Finally, the pump flow rate reference value computing section 131 compares the pump flow rate reference value 1 with the pump flow rate reference value 2, and outputs a higher pump flow rate reference value to the pump flow rate regulation device command value computing section 132 as a pump flow rate reference value.

The pump flow rate regulation device command value computing section 132 receives the regeneration amount regulation device command value input from the regeneration amount regulation device command value computing section 130 and the pump flow rate reference value input from the pump flow rate reference value computing section 131. First, the pump flow rate regulation device command value computing section 132 computes a pump flow rate reduction value in such a manner that the pump flow rate reduction value becomes higher as the input regeneration amount regulation device command value is higher using a preset table. Next, the pump flow rate regulation device command value computing section 132 outputs a value obtained by subtracting the pump flow rate reduction value from the input pump flow rate reference value as a pump flow rate regulation device command value.

Specifically, the pump flow rate reference value calculated by the pump flow rate reference value computing section 131 on the basis of the signals from the arm operation amount detection unit corresponds to a demanded flow rate of the second hydraulic pump 41*b* that is necessary for the second hydraulic actuator and necessary for the work. On the other hand, the pump flow rate regulation device command value computing section 132 computes the pump flow rate reduction value from the regeneration amount regulation device command value input from the regeneration amount regulation device command value computing section 130. This pump flow rate reduction value corresponds to a regeneration flow rate from the first hydraulic actuator that is added to the delivery flow rate of the second hydraulic pump 41*b*. The pump flow rate regulation device command value computing section 132 subtracts the regeneration flow rate from the first hydraulic actuator from the demanded flow rate of the second hydraulic pump 41*b* to compute a flow rate of the hydraulic working fluid to be delivered solely by the second hydraulic pump 41*b*, and outputs the command value to the regulator 42*b*.

Exercising such control makes it possible to reduce a flow rate of the hydraulic working fluid delivered by the second hydraulic pump 41*b* without changing the operating speed of the arm 33 and reduce fuel consumption.

It is noted that it is possible to increase the operating speed of the arm 33 if the pump flow rate regulation device command value computing section 132 outputs the pump flow rate reference value as the pump flow rate regulation device command value as it is without executing subtraction of the pump flow rate reduction value from the pump flow rate reference value.

In the present embodiment, it is possible to further improve fuel economy since the regeneration flow rate by the regeneration flow rate regulation device and the delivery flow rate of the second hydraulic pump can be controlled independently.

The second embodiment of the work machine according to the present invention described above can attain similar effects to those of the first embodiment described above.

Third Embodiment

Figure 5:
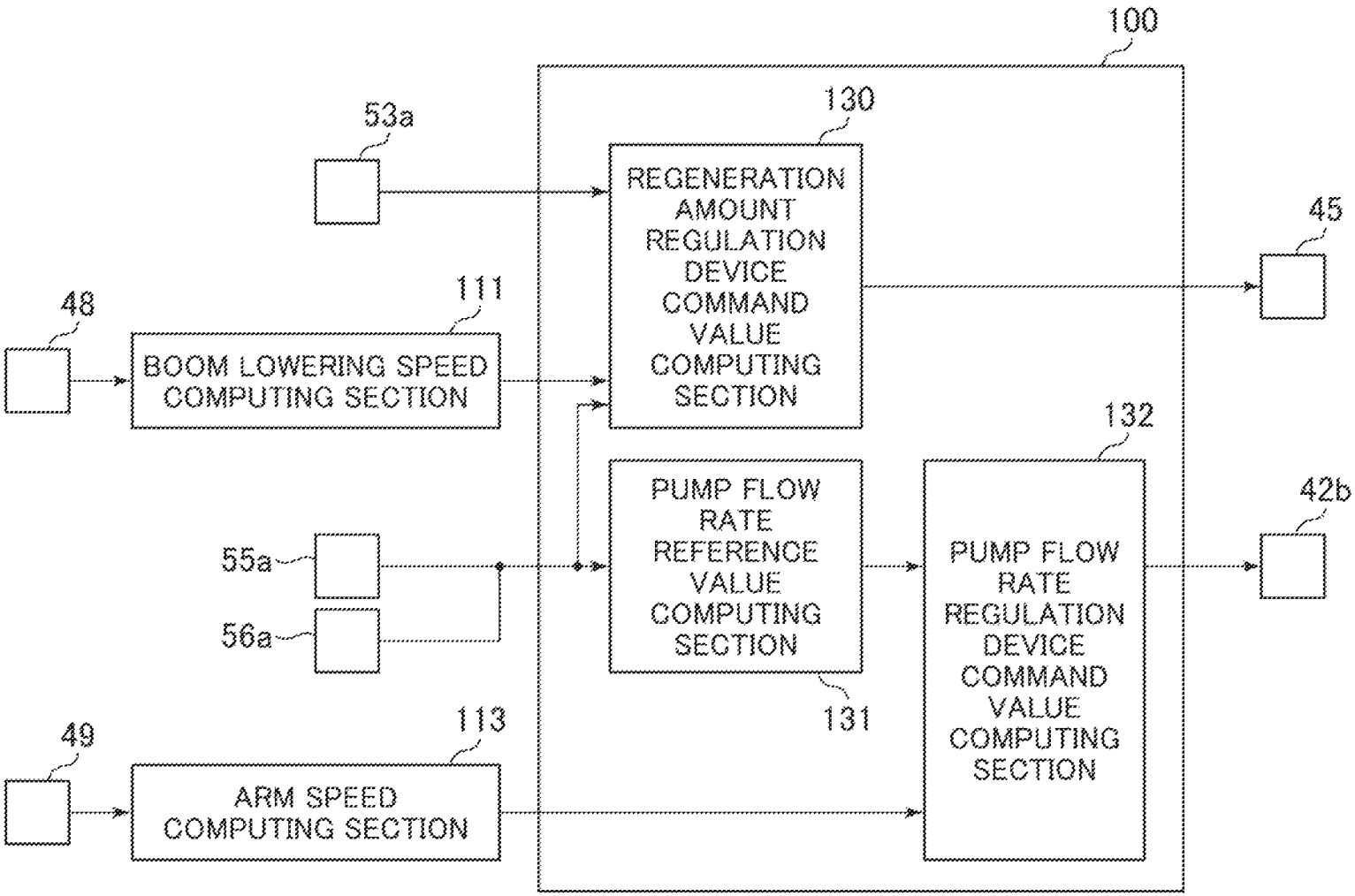
FIG. 5 is a control block diagram of a controller that configures a third embodiment of the work machine according to the present invention.

A third embodiment of the work machine according to the present invention will be described hereinafter with reference to the drawings. FIG. 5 is a control block diagram of a controller that configures the third embodiment of the work machine according to the present invention. In FIG. 5, constituent elements denoted by the same reference characters as those shown in FIGS. 1 to 4 are the same as those shown in FIGS. 1 to 4; detailed description thereof will be, therefore, omitted.

In the third embodiment of the work machine according to the present invention, the control block diagram is additionally configured with an arm speed computing unit 113, and the internal computation of the controller differs in a computation method of the pump flow rate regulation device command value computing section 132, compared with the control block diagram of the second embodiment shown in FIG. 4. Furthermore, the regeneration amount regulation device command value from the regeneration amount regulation device command value computing section 130 is not input to the pump flow rate regulation device command value computing section 132, and an arm speed signal from the arm speed computing unit 113 and the pump flow rate reference value from the pump flow rate reference value computing section 131 are input to the pump flow rate regulation device command value computing section 132.

The arm speed computing unit 113 is configured with, for example, the arm angle sensor 49 that detects the angle of the arm 33 with respect to the boom 31, and another controller that computes an angular speed by performing differential computation on the arm angle signal detected by the arm angle sensor 49 and that outputs a signal of the calculated angular speed to the pump flow rate regulation device command value computing section 132 of the controller 100 as an arm speed signal. This controller referred to as another controller is provided separately from the controller 100.

It is noted that the controller 100 may execute computation of the angular speed; in that case, a value detected by the arm angle sensor 49 is directly input to the controller 100. Furthermore, a displacement sensor (arm stroke sensor) that detects a displacement of the arm cylinder 34 may be used in place of the arm angle sensor 49. In this case, the controller computes the arm speed by differentiating the detected displacement signal similarly to the arm angle sensor 49. Moreover, if the angle sensor or the cylinder displacement sensor used in the arm speed computing unit 113 is commonly used as that used in the stability calculation or the computer aided construction during crane work, it is possible to achieve cost saving.

First, the pump flow rate regulation device command value computing section 132 computes an arm speed target value from the arm crowding operation amount when the arm crowding operation is performed and from the arm dumping operation amount when an arm dumping operation is performed, using a preset table. Next, the pump flow rate regulation device command value computing section 132 subtracts an actual arm speed (a value computed by the arm speed computing unit 113) from the computed arm speed target value to calculate a deviation. Finally, the pump flow rate regulation device command value computing section 132 computes the pump flow rate reduction value in such a manner that the pump flow rate reduction value is closer to a minimum value as the deviation is larger in the positive direction, and that the pump flow rate reduction value is closer to a maximum value as the deviation is larger in the negative direction using a preset table.

Specifically, when the actual arm speed is lower than the arm speed target value, the deviation becomes large in the positive direction. In this case, the pump flow rate regulation device command value computing section 132 makes the pump flow rate reduction value closer to the minimum value. By doing so, the pump flow reduction value subtracted from the pump flow rate reference value calculated by the pump flow rate reference value computing section 131 becomes the minimum value, and the pump flow rate regulation device command value computing section 132, therefore, outputs the command value to the regulator 42*b* in such a manner that the flow rate of the hydraulic working fluid to be delivered solely by the second hydraulic pump 41*b* increases. The actual arm speed thereby increases to be closer to the arm speed target value. Conversely, when the actual arm speed is higher than the arm speed target value, the deviation becomes large in the negative direction. In this case, the pump flow rate regulation device command value computing section 132 makes the pump flow rate reduction value closer to the maximum value. By doing so, the pump flow rate reduction value subtracted from the pump flow rate reference value becomes the maximum value, and the pump flow rate regulation device command value computing section 132, therefore, outputs the command value to the regulator 42*b* in such a manner that the flow rate of the hydraulic working fluid to be delivered solely by the second hydraulic pump 41*b* decreases. The actual arm speed thereby decreases to be closer to the arm speed target value.

Exercising control as described above enables the hydraulic pump flow rate to be regulated in such a manner that the actual arm speed conforms with the target speed. It is noted that control may be exercised on the basis of not the deviation but the integral value of the deviation, whereby it is possible to eliminate the stationary deviation. It is thereby possible to reduce the flow rate of the hydraulic working fluid delivered by the second hydraulic pump 41*b* without changing the operating speed of the arm 33 and reduce fuel consumption.

The third embodiment of the work machine according to the present invention described above can attain similar effects to those of the first embodiment described above.

Furthermore, according to the third embodiment of the work machine of the present invention described above, it is possible to reduce the flow rate of the hydraulic working fluid delivered by the second hydraulic pump 41*b* without changing the operating speed of the arm 33 and reduce fuel consumption.

Fourth Embodiment

Figure 6:
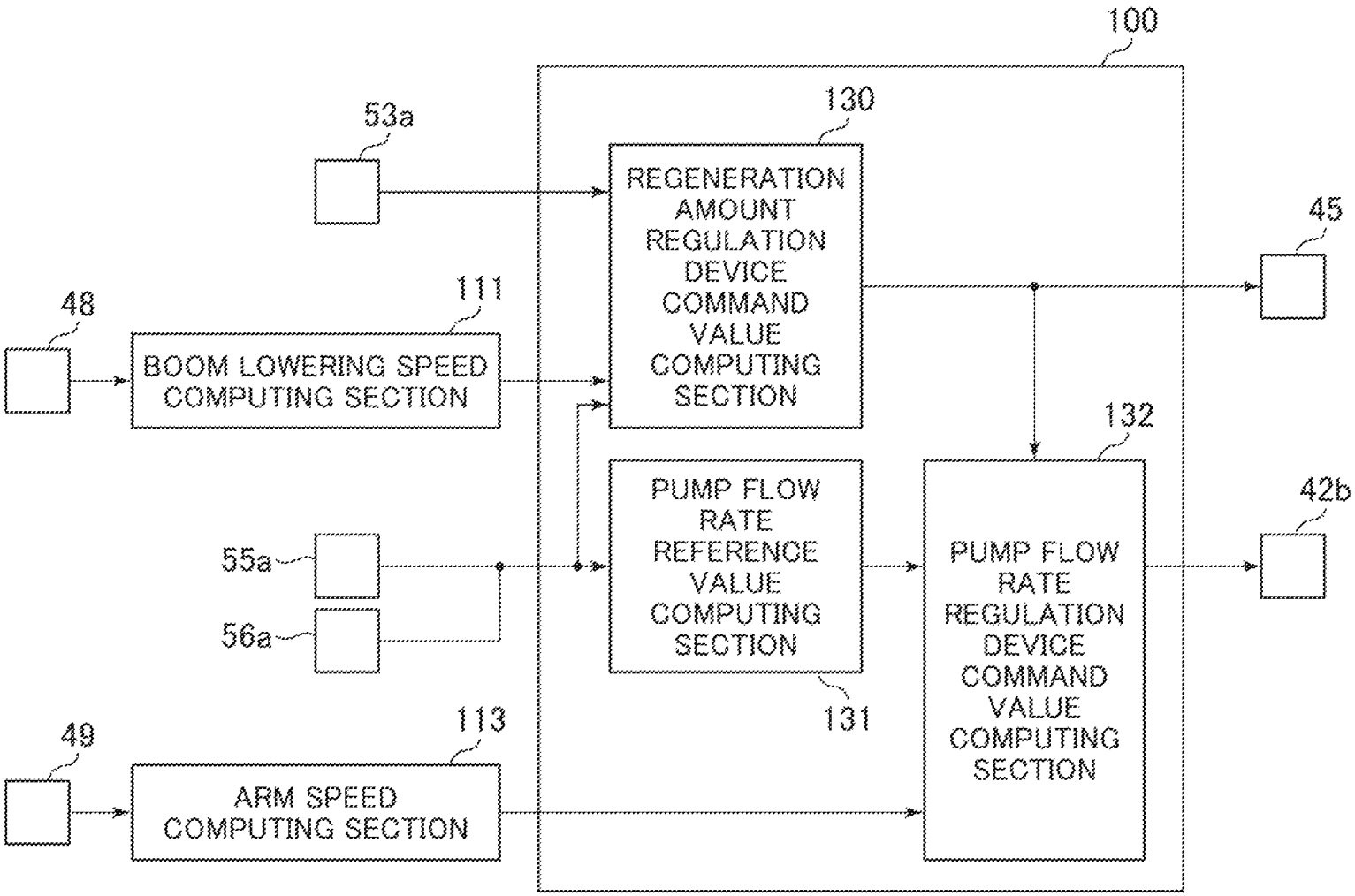
FIG. 6 is a control block diagram of a controller that configures a fourth embodiment of the work machine according to the present invention.

A fourth embodiment of the work machine according to the present invention will be described hereinafter with reference to the drawings. FIG. 6 is a control block diagram of a controller that configures the fourth embodiment of the work machine according to the present invention. In FIG. 6, constituent elements denoted by the same reference characters as those shown in FIGS. 1 to 5 are the same as those shown in FIGS. 1 to 5; detailed description thereof will be, therefore, omitted.

In the fourth embodiment of the work machine according to the present invention, the control block diagram differs from that of the third embodiment shown in FIG. 5 in the computation method of the pump flow rate regulation device command value computing section 132 in the internal computation of the controller 100. Furthermore, the regeneration amount regulation device command value from the regeneration amount regulation device command value computing section 130 is input to the pump flow rate regulation device command value computing section 132.

First, the pump flow rate regulation device command value computing section 132 computes the arm speed target value from the arm crowding operation amount when the arm crowding operation is performed and from the arm dumping operation amount when the arm dumping operation is performed, using the preset table. Next, the pump flow rate regulation device command value computing section 132 subtracts the actual arm speed (the value computed by the arm speed computing unit 113) from the computed arm speed target value to calculate the deviation. Finally, the pump flow rate regulation device command value computing section 132 computes the pump flow rate reduction value in such a manner that the pump flow rate reduction value is closer to the minimum value as the deviation is larger in the positive direction, that the pump flow rate reduction value is closer to the maximum value as the deviation is larger in the negative direction, and that the pump flow rate reduction value becomes higher as the regeneration amount regulation device command value from the regeneration amount regulation device command value computing section 130 is higher, using a preset two-dimensional table.

It is noted that control may be exercised on the basis of not the deviation but the integral value of the deviation, whereby it is possible to eliminate the stationary deviation. It is thereby possible to reduce the flow rate of the hydraulic working fluid delivered by the second hydraulic pump 41*b* without changing the operating speed of the arm 33 and reduce fuel consumption.

The fourth embodiment of the work machine according to the present invention described above can attain similar effects to those of the first embodiment described above.

Furthermore, according to the fourth embodiment of the work machine of the present invention described above, it is possible to reduce the flow rate of the hydraulic working fluid delivered by the second hydraulic pump 41*b* without changing the operating speed of the arm 33 and reduce fuel consumption.

The present invention is not limited to the first to fourth embodiments described above but encompasses various modifications. The abovementioned embodiments have been described in detail for describing the present invention so that the present invention is easy to understand. The present invention is not always limited to the embodiments having all the configurations. For example, the configuration of a certain embodiment can be partially replaced by the configuration of another embodiment or the configuration of another embodiment can be added to the configuration of the certain embodiment. Furthermore, for a part of the configuration of each embodiment, addition, deletion, and/or replacement of the other configuration can be made.

DESCRIPTION OF REFERENCE CHARACTERS

10: Track structure
11: Crawler
12: Crawler frame
13: Track hydraulic motor
20: Swing structure
21: Swing frame
22: Engine
26: Speed reduction mechanism
27: Swing hydraulic motor
30: Excavator mechanism
31: Boom
32: Boom cylinder (first hydraulic actuator)
33: Arm
34: Arm cylinder (second hydraulic actuator)
35: bucket
36: Bucket cylinder
40: Hydraulic system
41*a*: First hydraulic pump
41*b*: Second hydraulic pump
42*a*, 42*b*: Regulator (hydraulic pump flow rate regulation device)
43: Boom spool
44: Arm spool
44: Regeneration amount regulation device (regeneration control valve)
51: Boom operation device (first operation device)
52: Arm operation device (second operation device)
100: Controller
111: Boom lowering speed computing unit
113: Arm speed computing unit
130: Regeneration amount regulation device command value computing section
132: Pump flow rate regulation device command value computing section

The invention claimed is:

1. A work machine, comprising:

a front implement that includes a boom and an arm rotatably and pivotally supported by a tip end portion of the boom;

a first hydraulic actuator for driving the boom;

a second hydraulic actuator for driving the arm;

a first operation device that commands an operation of the first hydraulic actuator;

a second operation device that commands an operation of the second hydraulic actuator;

a hydraulic pump that supplies a hydraulic fluid to the second hydraulic actuator;

a regeneration circuit that regenerates a return hydraulic fluid from the first hydraulic actuator between the second hydraulic actuator and the hydraulic pump;

a discharge circuit that discharges the return hydraulic fluid from the first hydraulic actuator to a tank; and a regeneration amount regulation device that regulates a proportion of a flow rate of the return hydraulic fluid flowing to the regeneration circuit and a flow rate of the return hydraulic fluid flowing to the discharge circuit, wherein the work machine includes:

a first operation amount sensor that detects an operation amount of the first operation device;

a first speed computing unit that computes an actual lowering speed of the boom; and a controller that controls the regeneration amount regulation device on the basis of the operation amount of the first operation device detected by the first operation amount sensor and the actual lowering speed of the boom computed by the first speed computing unit, wherein the controller includes a regeneration amount regulation device command value computing section configured to compute a lowering speed target value of the boom on the basis of the operation amount of the first operation device detected by the first operation amount sensor, and compute a command signal to control the regeneration amount regulation device in such a manner that the return hydraulic fluid from the first hydraulic actuator flows more to the discharge circuit than to the regeneration circuit in a case where the actual lowering speed of the boom computed by the first speed computing unit is lower than the lowering speed target value of the boom, compared with cases other than the case.

2. The work machine according to claim 1, wherein the regeneration amount regulation device command value computing section computes a command signal to control the regeneration amount regulation device in such a manner that the return hydraulic fluid from the first hydraulic actuator flows more to the discharge circuit than to the regeneration circuit as the lowering speed target value of the boom computed on the basis of the operation amount of the first operation device detected by the first operation amount sensor is higher, and to control the regeneration amount regulation device in such a manner that the return hydraulic fluid from the first hydraulic actuator flows more to the discharge circuit than to the regeneration circuit as the actual lowering speed of the boom computed by the first speed computing unit is lower.

3. The work machine according to claim 1, including a hydraulic pump flow rate regulation device that regulates a delivery flow rate of the hydraulic pump on the basis of a command signal from the controller, wherein the controller includes a pump flow rate regulation device command value computing section that computes the command signal to control the hydraulic pump flow rate regulation device in such a manner that the delivery flow rate of the hydraulic pump becomes lower when the regeneration amount regulation device is controlled in such a manner that the return hydraulic fluid from the first hydraulic actuator flows more to the regeneration circuit than to the discharge circuit.

4. The work machine according to claim 1, wherein the work machine includes a hydraulic pump flow rate regulation device that regulates a delivery flow rate of the hydraulic pump on the basis of a command signal from the controller, the work machine includes a second operation amount sensor that detects an operation amount of the second operation device and a second speed computing unit that computes an actual speed of the arm, and the controller includes a pump flow rate regulation device command value computing section that computes the command signal to control the hydraulic pump flow rate regulation device on the basis of the operation amount of the second operation device detected by the second operation amount sensor and the actual speed of the arm computed by the second speed computing unit.

5. The work machine according to claim 4, wherein the pump flow rate regulation device command value computing section is configured to compute a speed target value of the arm on the basis of the operation amount of the second operation device detected by the second operation amount sensor, and compute the command signal to control the hydraulic pump flow rate regulation device in such a manner that a flow rate of the hydraulic pump decreases in a case where the actual speed of the arm computed by the second hydraulic actuator speed computing unit is higher than the speed target value of the arm, compared with cases other than the case.

6. The work machine according to claim 4, wherein the pump flow rate regulation device command value computing section that computes the command signal to control the hydraulic pump flow rate regulation device in such a manner that a flow rate of the hydraulic pump decreases as the speed target value of the arm computed on the basis of the operation amount of the second operation device detected by the second operation amount sensor is lower, and to control the hydraulic pump flow rate regulation device in such a manner that the flow rate of the hydraulic pump decreases as the actual speed of the arm computed by the second speed computing unit is higher.

7. The work machine according to claim 4, wherein the pump flow rate regulation device command value computing section computes the command signal to control the hydraulic pump flow rate regulation device on the basis of the operation amount of the first operation device detected by the first operation amount sensor when the first operation device performs a boom lowering operation and the actual lowering speed of the boom computed by the first speed computing unit.

* * * * *